US007866717B2

(12) United States Patent
Martinez

(10) Patent No.: US 7,866,717 B2
(45) Date of Patent: Jan. 11, 2011

(54) PORTABLE WASTE PACKAGING DEVICE

(76) Inventor: Hector Martinez, 105 E. High St., Watsonville, CA (US) 95076

( * ) Notice: Subject to any disclaimer, the term of this patent is extended or adjusted under 35 U.S.C. 154(b) by 0 days.

(21) Appl. No.: 12/584,438

(22) Filed: Sep. 4, 2009

(65) Prior Publication Data

US 2010/0283273 A1 Nov. 11, 2010

Related U.S. Application Data

(60) Provisional application No. 61/175,949, filed on May 6, 2009.

(51) Int. Cl.
*A01K 29/00* (2006.01)

(52) U.S. Cl. ..... 294/1.3; 294/1.4; 15/257.6

(58) Field of Classification Search ..... 294/1.3–1.5, 294/55; 15/257.1, 257.4, 257.6, 104.8; 119/170, 119/867; 241/168
See application file for complete search history.

(56) References Cited

U.S. PATENT DOCUMENTS 4,102,547 A * 7/1978 Williams ..... 294/1.3
4,765,666 A * 8/1988 Parks ..... 294/1.4
5,324,144 A * 6/1994 Katbi et al. ..... 407/114
5,667,264 A * 9/1997 Tanahara ..... 294/1.4
5,806,668 A * 9/1998 Bixby ..... 206/216

FOREIGN PATENT DOCUMENTS

FR 2631212 * 11/1989 ..... 294/1.3
WO WO 92/21857 * 12/1992

* cited by examiner

*Primary Examiner*—Paul T Chin
(74) *Attorney, Agent, or Firm*—Patrick Reilly

(57) ABSTRACT

A device for collecting and packaging solid waste or toxic material is provided. A first arm and a second arm are coupled with a lever, wherein at least one arm is slidably coupled with the lever. A bag may be positioned in an open position when the first arm is located distally from the second arm, and the bag may be closed by an operator manipulating the arms towards each other. The device may include a motor or a spring or springs to drive the arms towards or away from each other. A plate, a pole and a handle may be coupled with the arms. The plate may be positioned relative to the arms to stabilize the waste or toxic material for insertion into the bag. The bag may include an adhesive, paper, plastic, recycled plastic, cellulose in combination or singularity.

12 Claims, 10 Drawing Sheets

PORTABLE WASTE PACKAGING DEVICE

CROSS-REFERENCE TO CO-PENDING PATENT APPLICATIONS

This Nonprovisional Patent application is a continuation-in-part of Provisional Patent Application No. 61/175,949, filed on May 6, 2009 by inventor Hector Martinez hereby incorporated by reference in its entirety and for all purposes, to include claiming benefit of the priority data of filing of Provisional Patent Application No. 61/175,949.

FIELD OF THE INVENTION

The present invention relates to the field of biological waste and toxic material collection and management. The present invention more particularly relates to the collection and transfer of solid waste and toxic material.

BACKGROUND OF THE INVENTION

Solid waste and solid toxic materials are generated from many sources, to include by production and evacuation from animals as well as industrial processes. Farm laborers, zoo workers and pet owners are not unusually tasked with cleaning up waste matter or from the ground or otherwise deposited by animals, such as canines, cats, domesticated animals and/or animals maintained in confined areas.

Yet touching feces is almost universally repulsive and considered to be a degrading and undesirable act. The prior art includes efforts to maintain separation between a collector of animal waste or toxic matter and the material to be collected.

To solve the above stated problem it has been proposed to collect the pet's excrement by means of small shovels, placing the depositions into bags that when closed are discarded into any street or public trash collector.

U.S. Pat. No. 6,059,332 discloses a domestic pet's excrement collector. The invented collector includes two similar rectangular structures facing each other and joined in between by a posterior concave-convex wall forming a pincer-shaped hinge for the collector. Over the convex face of the wall is fixed a cylindrical tube closed at one end, having inside of the tube a roll of continuous bags, while the other end of the tube is closed by a lid. The plastic bag is placed covering the collecting pincers. The bottom of the bag is contained within the pincers towards the cylindrical tube. This complex construction does not relate to the present invention.

U.S. Pat. No. 7,523,972 discloses a portable waste remover with integrated bag. The invented waste remover includes a handle, a housing portion for holding and dispensing bags, and a grabbing assembly actuated by a spring and pulley assembly contained in the handle. The grabbing assembly is further coupled to a first and second frame member wherein the frame members are capable of pivotally attachment to the housing portion. The first and second pivot arms may have removable clamps that either secure the frame members for grabbing waste or detach from the frame members making them collapsible. The housing portion may be configured in the shape of a tube with a roller and having a slotted groove disposed where disposable bags may be fitted around the roller and dispensed through the slotted groove. In another configuration, the grabber assembly engaging the handle is comprised of a button, spring, spring arm with shoulder, and toothed elongated arm engaging the frame members.

There is a long-felt need to provide a device that optimally enables a human to collect animal solid waste, or other solid toxic material, without requiring the device operator to handle or touch the solid material.

None of the mentioned prior-art patents offers a construction similar to this present invention, nor provide a solution having a low cost base structure or frame including a movable arm, to which is attached a disposable plastic bag within which the pet's depositions are collected, such as disclosed herein. Once the bag has been used, the bag may be withdrawn in a rapid and hygienic manner.

SUMMARY OF THE INVENTION

This and other objects of the present invention are made obvious in light of this disclosure, wherein a device is provided for collecting and bagging solid waste is provided. According to a first device, a first arm and a second arm are coupled with a lever, wherein at least one arm is slidably coupled with the lever. A bag may be positioned in an open position when the first arm is located distally from the second arm, and the bag may be closed by a device user manipulating the arms towards each other.

The first device may optionally include a motor that provides mechanical force applicable to drives the arms towards and/or away from each other. Additionally or alternatively, an optional spring or springs may be attached to the arms or lever to drive the arms towards and/or away from each other.

In alternate devices, the mechanical force applied to drive the arms towards and/or away from each other may be translated to one or both arms by a chain or a cable element.

In still alternate devices, plate, a pole and/or a handle may be coupled with the arms. The plate is positioned relative to the arms to stabilize the waste or toxic material for insertion into the bag. The pole and/or handle may be configured to reduce or eliminate the degree of bending required by the device user during the process of collected waste or toxic material.

In certain alternate variations, the bag may include paper, plastic, recycled plastic, vegetable matter and/or cellulose. Alternatively or additionally, the bag further includes an internal adhesive proximate an aperture of the bag.

In certain still alternate variations, the bag maintains a barrier between the device and keeps the waste material from contaminating or touching the device. A handle for the device may allow the user to collect and package the waste material in a bag without directly touching the waste material. Soiling of the user's hands, skin, footwear or clothing by the waste can thus be avoided.

The foregoing and other objects, features and advantages will be apparent from the following description of aspects of the present invention as illustrated in the accompanying drawings.

INCORPORATION BY REFERENCE

All publications mentioned herein are incorporated herein by reference to disclose and describe the methods and/or materials in connection with which the publications are cited. All publications, patents, and patent applications mentioned in this specification are herein incorporated by reference in their entirety and for all purposes to the same extent as if each individual publication, patent, or patent application was specifically and individually indicated to be incorporated by reference.

Such incorporations include U.S. Pat. No. 4,196,365 (Inventor: Presley, D.; issued on Apr. 1, 1980) titled "Magnetic motor having rotating and reciprocating permanent magnets"; U.S. Pat. No. 4,878,869 (Inventor: Yuji Yamane et al.;

issued on Nov. 7, 1989) titled "Toys having magnetic switches"; U.S. Pat. No. 6,059,332 (Inventor: Beascoechea Inchaurraga; Issued on May 9, 2000) titled "Collector for excreta from domestic animals"; U.S. Pat. No. 7,095,155 (Inventor: Takeuchi, K.; issued on Aug. 22, 2006) titled "Motor and drive control system thereof"; U.S. Pat. No. 7,523,972 (Inventor: Wawrzynowski, Michael; Issued on Apr. 28, 2009) titled "Portable waste remover with integrated bag"; and U.S. Pat. No. 7,216,905 (Inventor: Armes, Jr., A.; Issued on May 15, 2007) titled "Refuse removal system and method for removing refuse".

The publications discussed or mentioned herein are provided solely for their disclosure prior to the filing date of the present application. Nothing herein is to be construed as an admission that the present invention is not entitled to antedate such publication by virtue of prior invention. Furthermore, the dates of publication provided herein may differ from the actual publication dates which may need to be independently confirmed.

BRIEF DESCRIPTION OF THE FIGURES

These, and further features of various aspects of the present invention, may be better understood with reference to the accompanying specification, wherein.

DETAILED DESCRIPTION

It is to be understood that this invention is not limited to particular aspects of the present invention described, as such may, of course, vary. It is also to be understood that the terminology used herein is for the purpose of describing particular aspects only, and is not intended to be limiting, since the scope of the present invention will be limited only by the appended claims.

Methods recited herein may be carried out in any order of the recited events which is logically possible, as well as the recited order of events.

Where a range of values is provided herein, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the methods and materials are now described.

It must be noted that as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

Figure 1A:
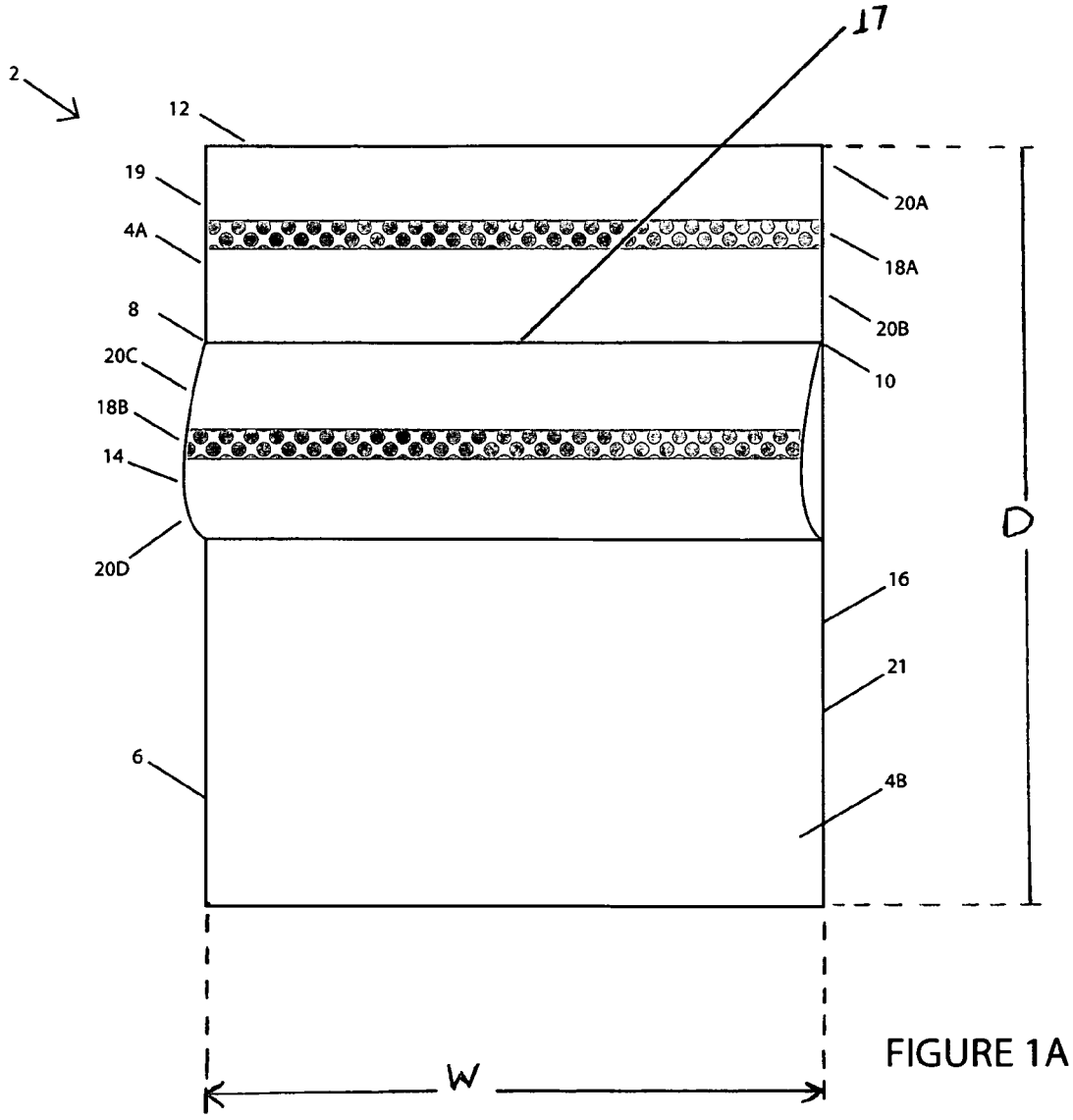
FIG. 1A illustrates a bag having pocket, two flaps and a plurality of optional adhesive strips.

Referring now to FIG. 1A a bag 2 is formed by a first sheet 4A and a second sheet 4B joined along a seam 6 from a first joining point 8 to a second joining point 10. The bag 2 may be or comprise paper, plastic, recycled plastic, vegetable matter and/or cellulose. Alternatively or additionally, the bag 2 may be or comprise polyethylene or other suitable plastic material known in the art.

A first flap 12 is comprised of a portion of the first sheet 4A extending from the first joining point 8 and the second joining point 10. A second flap 14 is comprised of a portion of the second sheet 4B extending from the first joining point 8 and the second joining point 10. An open pocket 16 is formed defined by the seam 6. One or more internal adhesive strips 18A of the first flap 12 and/or one or more internal adhesive strips 18B of the second flap 14 are located on an internal side 19 of the bag 2. Additionally, alternatively of optionally one or more external adhesive strips 20A-20D are located an external side 21 of either or both the first flap 12 and/or the second flap 14 of the bag 2.

The clips may be or comprise a binder clip product number LOP13351 as marketed by Legacy Office Products of Indianapolis, Ind.

The pocket 16 extends from an opening 17 and away from the first flap 12 and the second flap in a depth dimension D. The opening 17 extends from the first joining point 8 and the second joining point 10. The first flap 12 and the second flap 14 extending from the opening 17 and away from the pocket 16 along the depth dimension D.

The first flap 12 and the second flap 14 preferably extend, in various alternate preferred embodiments of the present invention, for a linear length along the depth dimension D selected from the depth range of from one inch to two feet and away from the pocket 16.

The pocket 16 preferably extends, in various yet alternate preferred embodiments of the present invention, along the depth dimension D for a linear length selected from the range of from one inch to two feet and away from the opening 17, the first flap 12 and the second flap 1.

The pocket 16, first flap 12 and/or the second flap 14 preferably extend for a linear length of from one inch to two feet along a width dimension W in various even alternate preferred embodiments of the present invention, wherein the width dimension W is orthogonal to the depth dimension D.

In various other additional alternate preferred embodiments of the present invention, the pocket 16, first flap 12 and/or the second flap 14 preferably extend for a linear length selected from the range of from one inch or less or two feet or more along the width dimension W and/or the depth dimension D. In various still additional alternate preferred embodiments of the present invention, the pocket 16, first flap 12 and/or the second flap 14 preferably extend for a linear length selected from the range from 0.1 or less to more than two feet along the width dimension W and/or the depth dimension D.

Figure 1B:
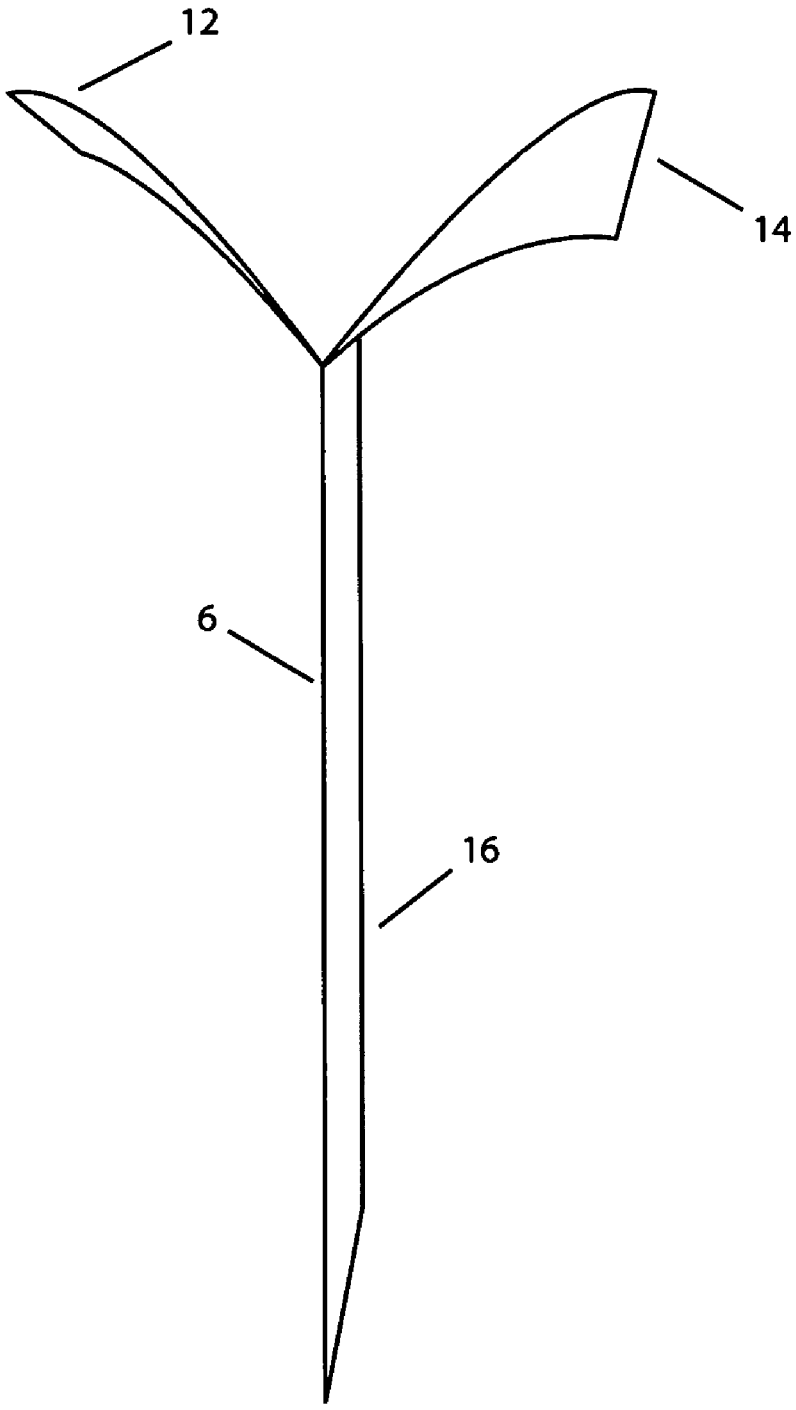
FIG. 1B is a side view of the bag of FIG. 1A.

Referring now to FIG. 1B is a side view of the bag 2 of FIG. 1A, where in the first flap 12 and the second flap 14 are separated and the pocket 16 is partially open. The seam 6 maintains the integrity of the pocket 16 in both an open and a closed position.

It is understood that the seam 6 may be formed with an adhesive (not shown) or a heating and a compression of the first sheet 4A and the second sheet 4B. It is further understood that the bag 2 may be formed without the seam 6 and according to suitable means known in the art.

Figure 1C:
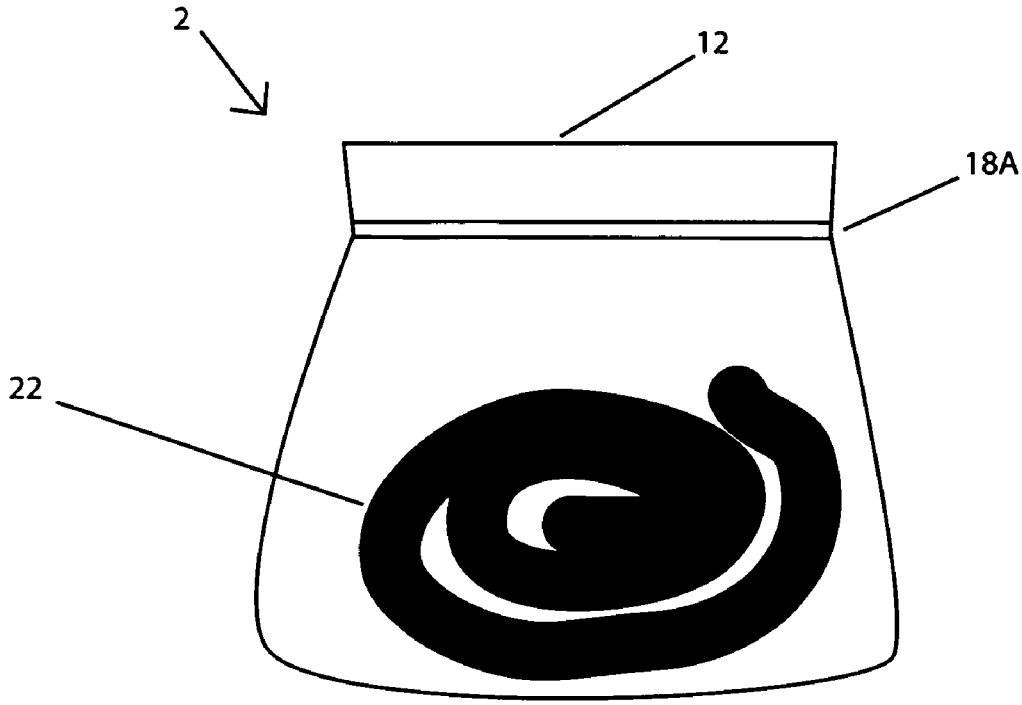
FIG. 1C is a front view of the bag of FIGS. 1A and 1B containing a waste material sealed in the pocket by one or more adhesive strips.

Referring now to FIG. 1C is a front view of the bag 2 of FIGS. 1A and 1B containing a waste material 22 sealed in the pocket 16 by one or more internal adhesive strips 18A. The pocket 16 is thus defined by the seam 6 and a seal formed by a first internal adhesive strip 18A and a second adhesive strip 18B, and the first flap 12 and the second flap 14 extend away from the pocket 16 for more acceptable handling of the bag 2 as it encloses the waste material 22.

The waste material 22 may be or comprise animal feces, toxic waste, biological matter, industrial waste, vegetable matter, and/or unwanted or undesired material or substance in combination or singularity.

Figure 2:
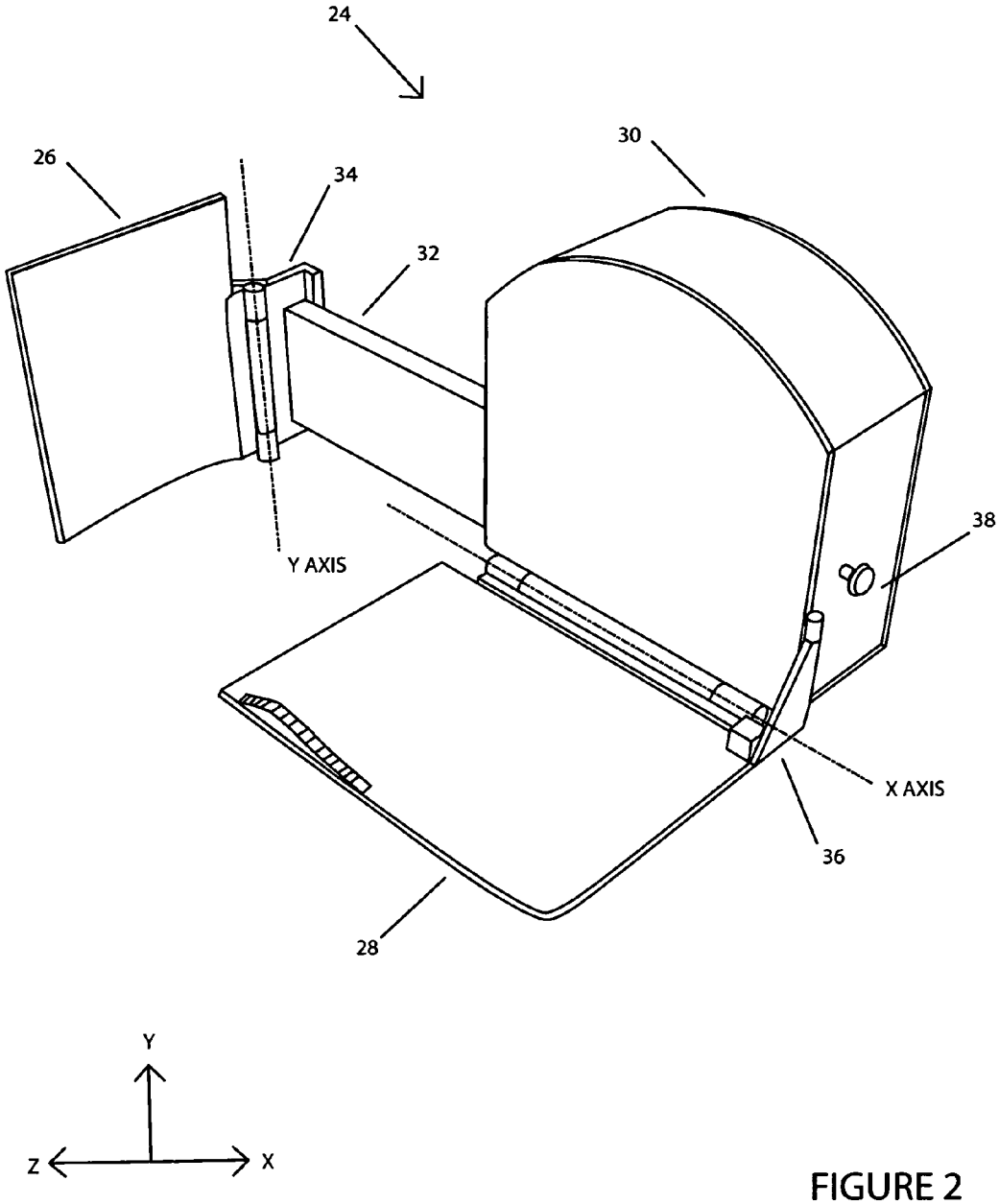
FIG. 2 is a perspective view of a waste capturing device, or "scooper", in an open position.

Referring now to FIG. 2 is a perspective view of a waste capturing device 24, or "scooper" 24, in an open position. An arm 26 and a plate 28 are configured to allow the arm 26 to be positioned distally from the plate 28 and a housing 30 by movement of a linear actuator 32 (hereinafter, "lever" 32). The arm 26 and the lever 32 are coupled by an arm hinge assembly 34, wherein the arm hinge assembly 34 enables the arm to be rotated along a Y-axis. The plate 28 and the housing 30 are coupled by a plate hinge assembly 36, wherein the plate hinge assembly 36 enables the plate 28 to be rotated about a Y-axis. The X-axis and the Y-axis are mutually orthogonal to each other and, both the Y-axis and the Z-axis are mutually orthogonal to a third Z-axis.

A three state actuation button 38 enables the actuation of a process of positioning the arm 26 relative to the plate 28 as described herein.

One or more elements 26-38 of the scooper 24 consist of, or comprise, aluminum, iron, stainless steel or other suitable metal, metal alloy or material known in the art. Additionally or alternatively, one or more elements 26-38 of the scooper 24 may consist of, or comprise polystyrene, polyvinyl chloride, polyethylene, polypropylene, or other suitable thermoplastic polymer or plastic polymer known in the art.

Preferably the scooper 24 has a total weight of less than five pounds. More preferably the scooper 24 has a total weight of less than two pounds and more than 0.25 pounds. Most preferably the scooper 24 has a combined weight of less than one pound.

Preferably the scooper 24 has a total weight of less than five pounds. More preferably the scooper 24 has a total weight of less than two pounds and more than 0.25 pounds. Most preferably the scooper 24 has a combined weight of less than one pound.

In certain applications, preferably the scooper 24 is shaped to fit within a three dimensional volume of less than 0.500 cubic feet. In alternate applications and certain other alternate preferred embodiments, the scooper is preferably shaped to fit within a volume defined when the arm 26 is fully extended in by the limits of less than two foot along the X-axis, one foot along the Y-axis, and less than one foot along the Z-axis.

In various alternate preferred embodiments, the arm 26 comprises a shovel plate that (as deployed in the open position of the device 24) has a first dimension along y-axis between eight inches and one inch, a second dimension along the Z-axis between eight inches and one inch, and a third dimension along the X-axis of less than 0.25 inches; and/or the plate 28 comprises an flat element that has a first dimension between eight inches and one inch, a second dimension between eight inches and one inch, and a third dimension of less than 0.25 inches.

The bag 2 is sized and shaped to present an opening when attached the scooper 24 that is approximately as long as the first dimension or second dimension of the plate 28. The first flap 12 and the first flap 14 may be configured to be as wide along the W axis as the first dimension or second dimension of the plate 28 or the arm 26

Figure 3:
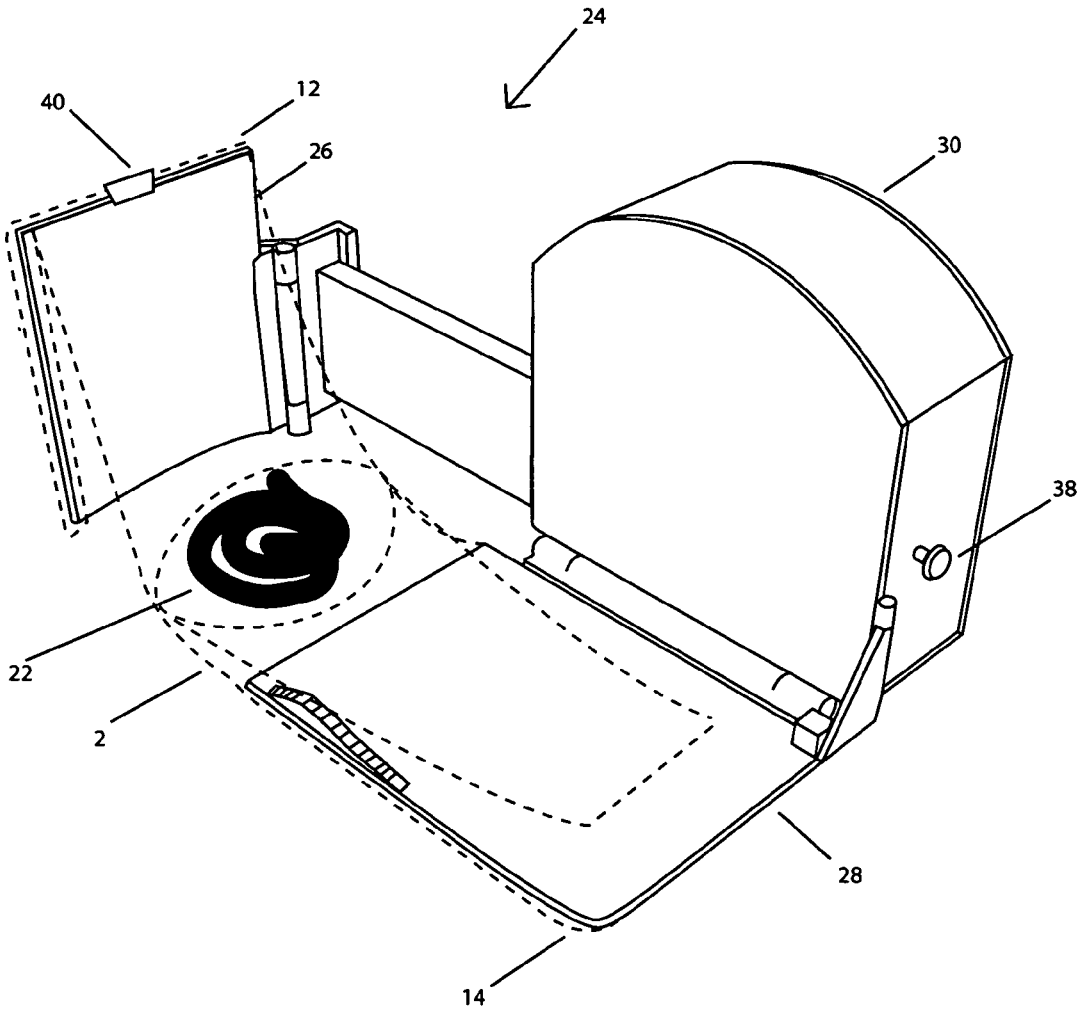
FIG. 3 is a perspective view of the scooper of FIG. 2 with the bag of FIGS. 1A-1C attached and partially enclosing a waste material.

Referring now to FIG. 3 is a perspective view of the scooper 24 of FIG. 2 with the bag of FIGS. 1A-1C attached and partially enclosing a waste material 22. The first flap 12 is held to the arm 26 by a first clip 40 and or one or more external adhesive strips 20A-20D. The second flap 14 is held to the arm 26 by a second clip 42 and or one or more external adhesive strips 20A-20D. The pocket 16 is positioned proximate to and substantially around the waste material 22.

Figure 4:
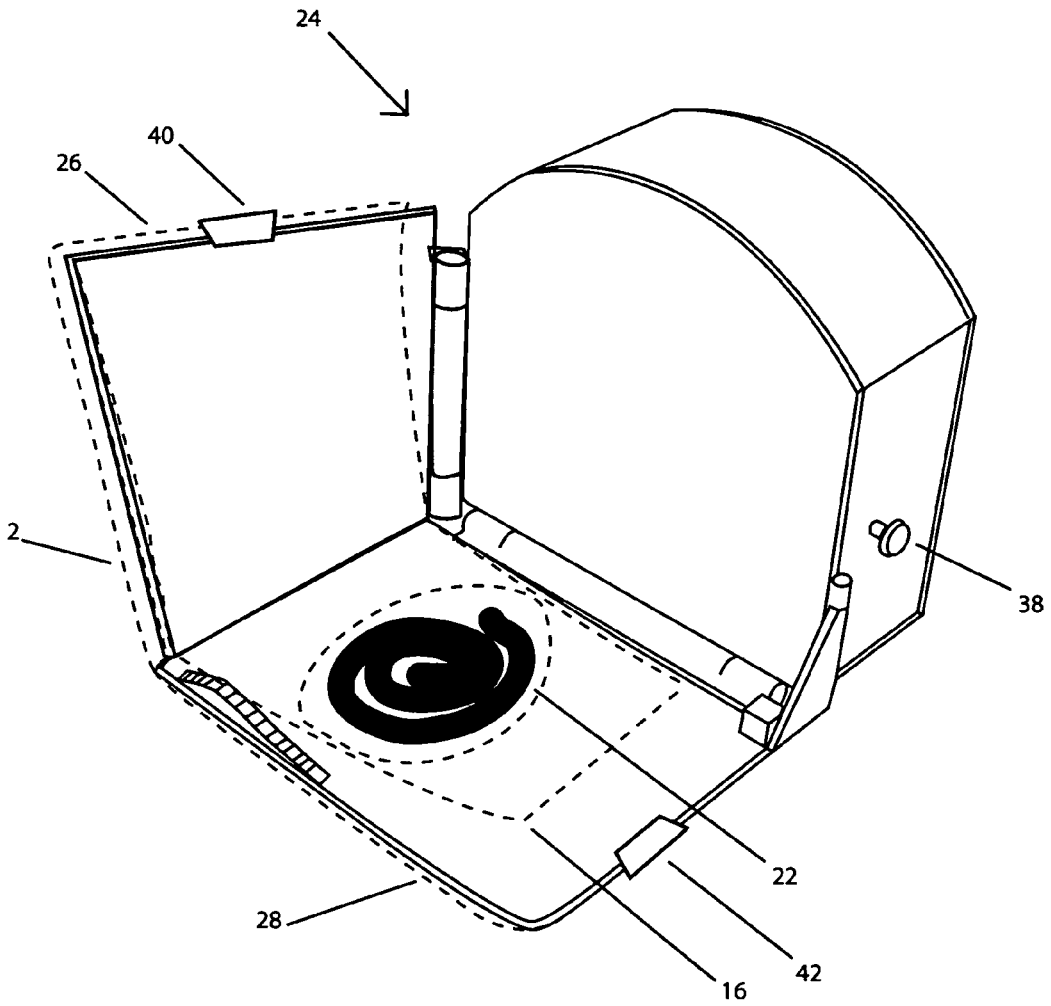
FIG. 4 is a perspective view of the scooper of FIGS. 2 and 3 in a closed positioned, wherein the waste material is substantially enclosed in the pocket of the bag of FIGS. 1A-1C and 3.

Referring now to FIG. 4 is a perspective view of the scooper 24 of FIGS. 2 and 3 in a closed positioned, wherein the waste material 22 is substantially enclosed in the pocket 16. The arm 26 is driven forward along the X-axis and causes the material 22 to be captured by the pocket 16. One or more internal adhesive strips 18A and 18B create and maintain a sealed edge of the pocket 16.

Figure 5:
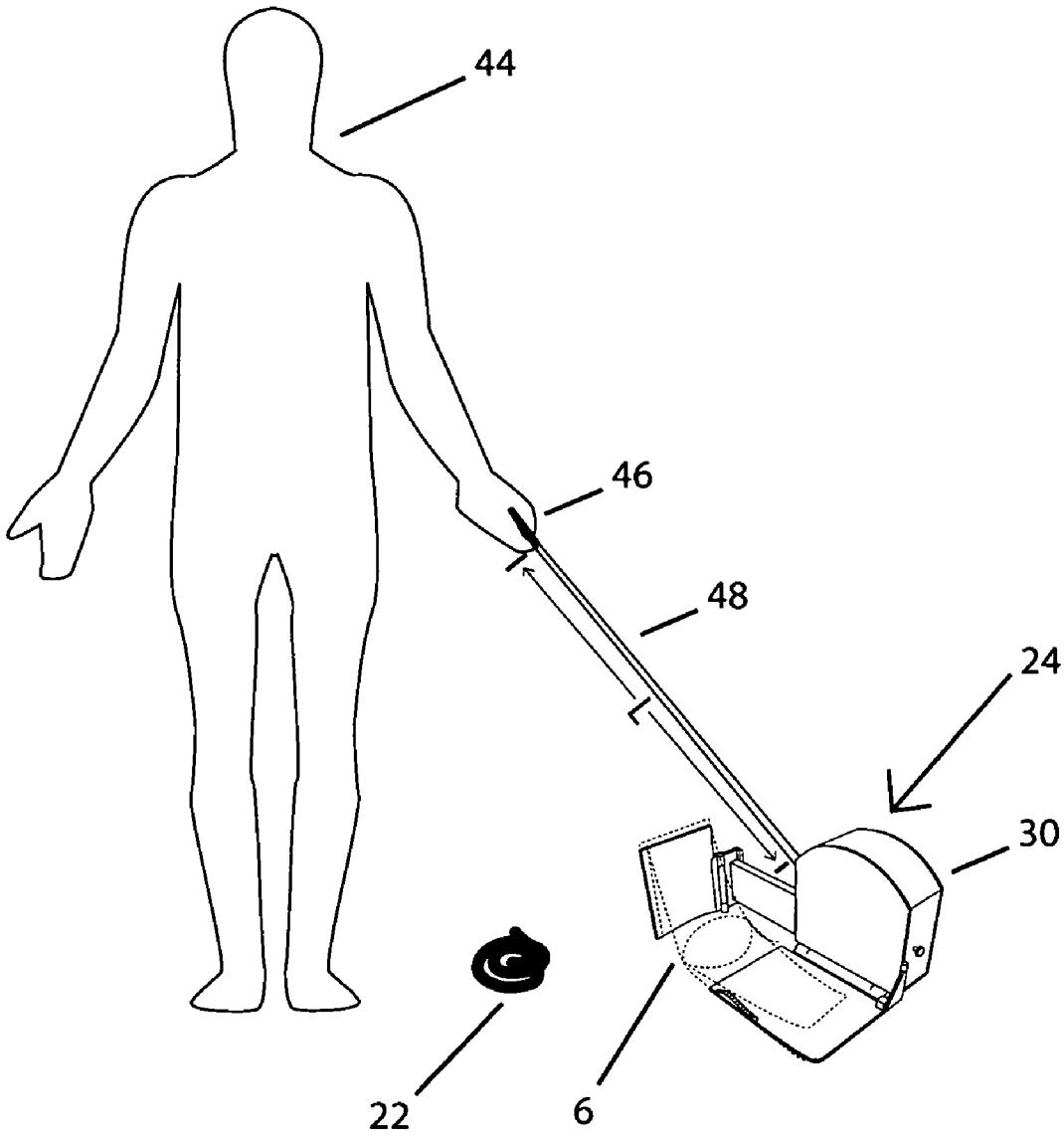
FIG. 5 is a first alternate variation of the present variation that includes a pole attached to the scooper.

Referring now to FIG. 5 is a first alternate variation of the present variation that allows a user 44 to grasp a handle 46 of a pole 48, wherein the pole 48 is attached to the housing 30 of the scooper 24. The pole 48 may be configured with a linear length L extending for a length in the range from six inches to five feet in various alternate configurations. Preferably the pole 48 presents a cross-sectional diameter in a plane normal to the linear length L in the range of two inches to 0.25 inches. More preferably the pole 48 presents a cross-sectional diameter in a plane normal to the linear length L in the range of one inch to 0.5 inches. Preferably the handle 46 presents a cross-sectional diameter in a plane normal to the linear length L in the range of one inch to 0.25 inches. More preferably the handle presents a cross-sectional diameter in a plane normal to the linear length L in the range of one inch to 0.5 inches.

One or more elements 26-38 of the handle 46 and the pole 48 may be consist of, or comprise, aluminum, iron, stainless steel, or other suitable metal, metal alloy or material known in the art. Additionally or alternatively the handle 46 and pole 48 may consist of, or comprise polystyrene, polyvinyl chloride, the polyethylene and polypropylene, or other suitable thermoplastic polymer or plastic polymer known in the art. Preferably the scooper 24, pole 48 and handle 46 have a total combined weight of less than five pounds. More preferably the scooper 24, pole 48 and handle 46 have a total combined weight of less than two pounds and more than 0.25 pounds. Most preferably the scooper 24, pole 48 and handle 46 have a combined weight of less than one pound.

Figure 6:
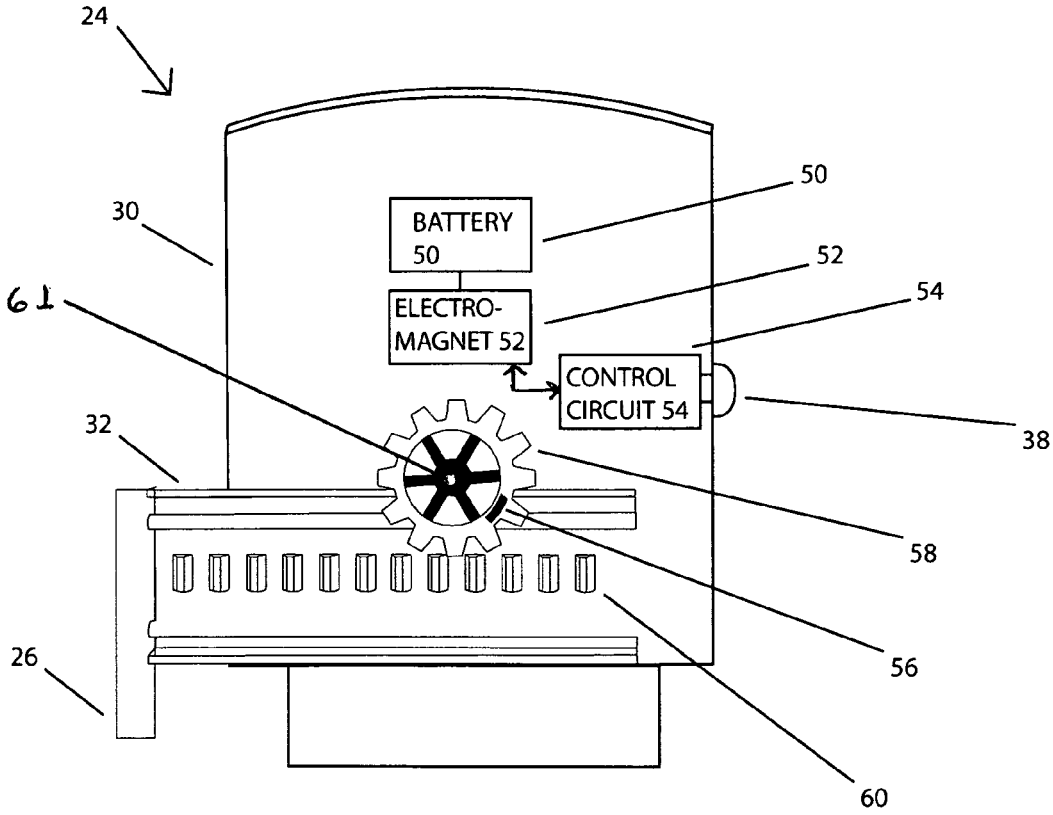
FIG. 6 is a schematic diagram of electromechanical aspects of the scooper of FIGS. 2-5.

Referring now to FIG. 6 is a schematic diagram of electromechanical aspects of the scooper 24 of FIGS. 2-5. An electric battery 50 provides electrical power to an electromagnet assembly 52 and a control circuit 54. The control circuit 54 is coupled to the control button 38 and the control circuit 54 is configured to cause the electromagnet to spin a magnet 56 of a circular gear 58 to rotate in either a clockwise or a counter clockwise rotation in reference to rotation about the Y-axis.

The battery 50, the electromagnetic assembly 52, the control circuit 54, the magnet 56 and the circular gear 58 are coupled to the housing 30.

The circular gear 58 engages with a plurality of teeth 60 of the lever 32, thereby translating the rotational motion about the Y-axis of the circular gear 58 into linear motion along the X-axis. The resultant linear motion of the lever 32 along the X axis causes the arm 26 to move toward or away from the plate 28, whereby the scooper translates to and from open position as illustrated in FIGS. 2 and 3 and to the closed positioned of FIG. 4.

One or more elements 50-60 of the scooper 24 consist of, or comprise, a magnetized metal, aluminum, iron, stainless steel or other suitable metal, metal alloy or material known in the art. Additionally or alternatively, one or more elements 26-38 of the scooper 24 may consist of, or comprise polystyrene, polyvinyl chloride, polyethylene, polypropylene, or other suitable thermoplastic Polymer or plastic polymer known in the art.

The control, button 38 is a three position control that the user 44 manually positions in an off state, a second state and a third state. When the control button 38 is in the off state the control circuit 54 either electrically disconnects or fails to electrically connect the battery 50 to the electromagnet assembly 52. When the control button 38 is in the second state, the control circuit 54 electrically connects the battery 50 to the electromagnet assembly 52 and/or directs the circular gear 58 to rotate in a first rotational direction about the Y-axis that causes the lever 32 to extend out from the housing 30 along the X-axis, and thereby position the arm 28 in the open position. disconnects or fails to electrically connect the battery 50 to the electromagnet assembly 52. When the control button 38 is in the third state, the control circuit 54 electrically connects the battery 50 to the electromagnet assembly 52 and/or directs the circular gear 58 to rotate in a second rotational direction about the Y-axis that causes the lever 32 to move into the housing 30 along the X-axis, and thereby position the arm 28 in the closed position.

The circular gear 58 may be rotatably coupled to a fixed axle 61, wherein the axle 61 is coupled with housing 30 and a magnet field generated by the electromagnet assembly 52 acts upon the magnet 56 to drive the magnet 54 around the axle 61 and thereby cause the circular gear 58 to rotate about the axle 61. The circular gear 58 engages with the teeth 60 of the lever 32 as the circular gear 58 rotates and thereby drives linear motion of the lever 32.

Alternatively the circular gear 58 may be driven as controlled by the control circuit 54 and by a Kinmore™ electric toy motor model number KM-16T050 as marketed by Shenzhen Kinmore Motor Co. Ltd. of Nanshan District, Shenzhen, Guangdong, People's Republic of China.

Figure 7:
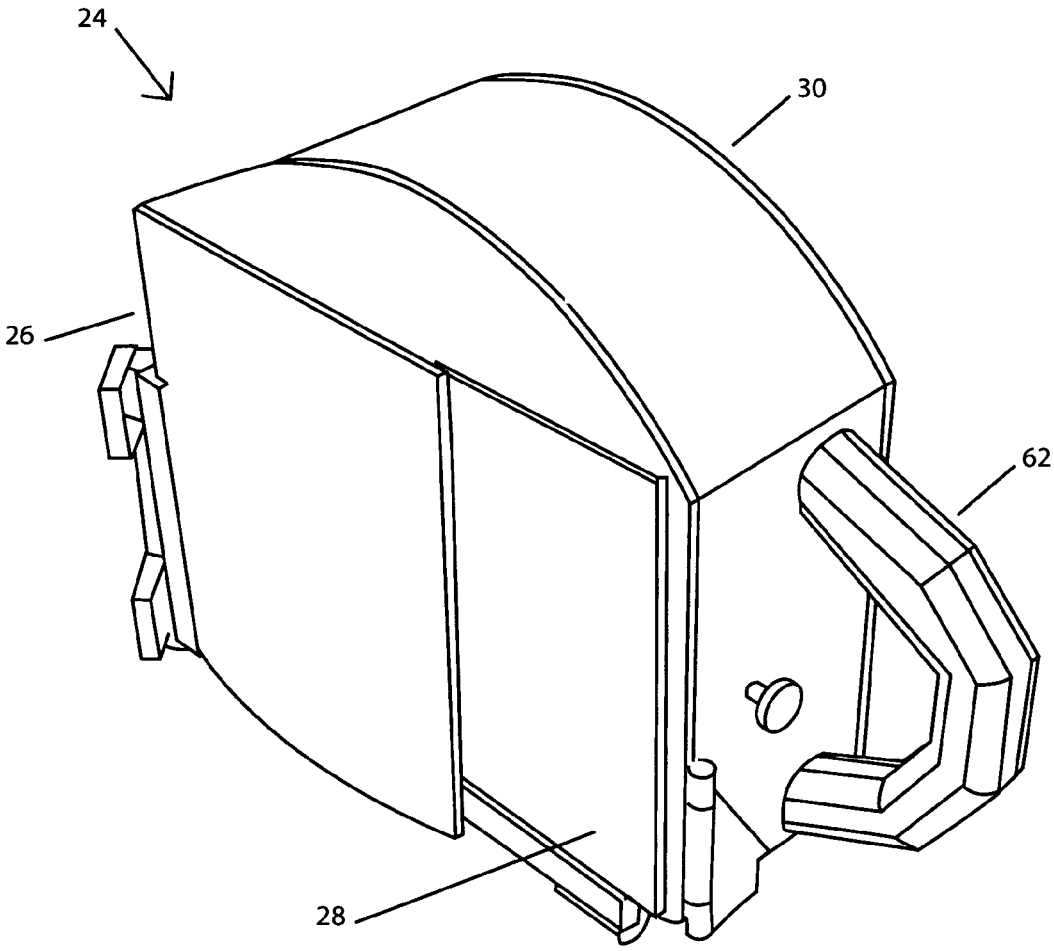
FIG. 7 is a perspective view of the scooper of FIGS. 2-6 in a travel position.

Referring now to FIG. 7 is a perspective view of the scooper 24 of FIGS. 2-6 in a travel position, wherein the arm 26 and the plate 28 are each positioned to align substantially parallel to an X-Y plane defined by the X-axis and the Y-axis. The positioning of the arm 26 toward the X-Y plane orientation is facilitated by the arm hinge assembly 34, and the positioning of the lever 28 toward the X-Y plane orientation is facilitated by the plate hinge assembly 36. An optional manual handle 62 further increases the ease with which the scooper 24 may be transported.

Figure 8:
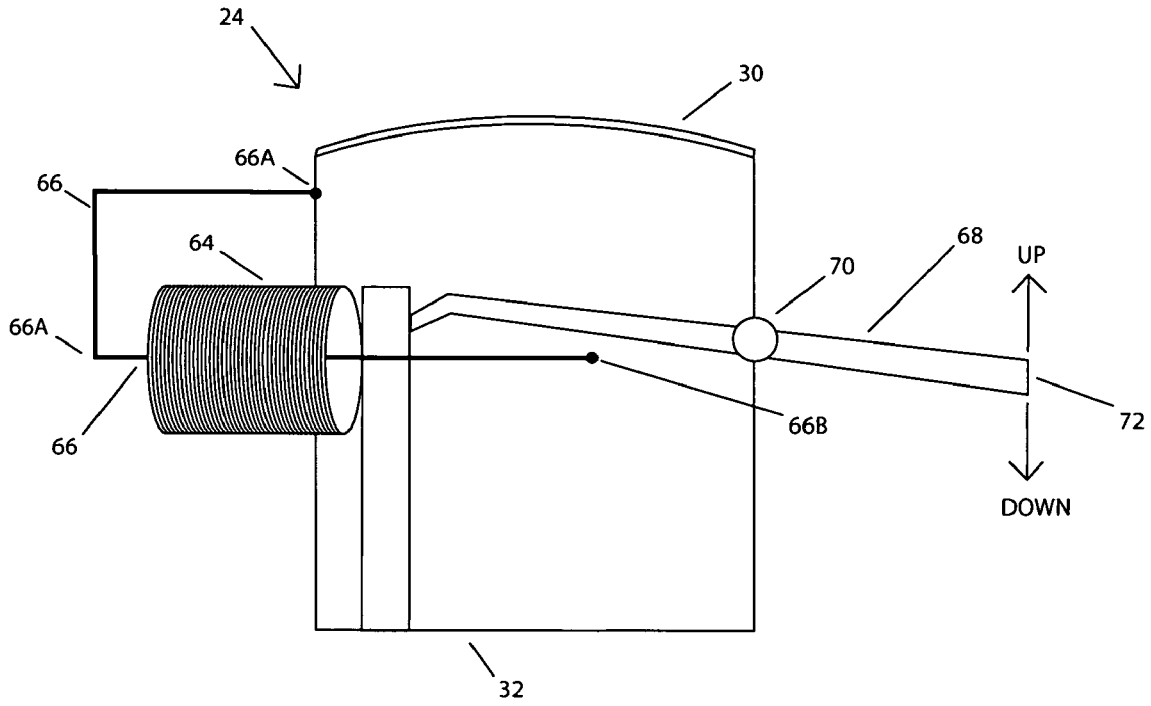
FIG. 8 is a schematic of a second alternate variation of the present invention of FIGS. 1-6 wherein a spring-actuated mechanism is provided.

Referring now to FIG. 8 is a schematic of a second alternate variation of the present invention of FIGS. 1-6 wherein a spring-actuated mechanism is provided. A spring 64 is coupled to the housing 30 by a spring guide 66. The spring guide 66 is coupled to the housing at a first guide point 66A and a second guide point 66B. A trigger 68 is rotatably coupled to the housing 30 by a rotational coupling 70, and may be rotated to maintain the arm 26 in the open position of FIGS. 2 and 3. The spring 64 directs a spring force to the arm 26 to cause the arm 26 to move along the X-axis and toward the plate 28 and to assume the closed position of FIG. 4. The user 44 manually rotates the trigger 68 by pressing the trigger end 72 in the up or down direction. Pressing the trigger end 72 in the up direction causes the trigger to enable a maintenance of the arm 26 in the open position of FIGS. 2 and 3. Pressing the trigger end 72 in the down position causes the trigger 68 to rotate and to enable the spring 64 to drive the arm 26 towards the plate 28 and form the closed position of FIG. 5.

The foregoing disclosures and statements are illustrative only of the present invention, and are not intended to limit or define the scope of the present invention. The above description is intended to be illustrative, and not restrictive. Although the examples given include many specificities, they are intended as illustrative of only certain possible applications of the present invention. The examples given should only be interpreted as illustrations of some of the applications of the present invention, and the full scope of the Present Invention should be determined by the appended claims and their legal equivalents. Those skilled in the art will appreciate that various adaptations and modifications of the just-described applications can be configured without departing from the scope and spirit of the present invention. Therefore, it is to be understood that the present invention may be practiced other than as specifically described herein. The scope of the present invention as disclosed and claimed should, therefore, be determined with reference to the knowledge of one skilled in the art and in light of the disclosures presented above.

What is claimed is:

1. A portable waste removal portable device comprising:

a. an arm coupled with a lever, the lever having a first end and a side end, wherein the arm is coupled with the lever at the first end;

b. a plate, wherein the plate is coupled with the side end of the lever;

and c. a bag having a pocket opening, the bag removably attached to the arm and the plate proximate to the pocket opening, wherein the bag is in an open position when the fl~arm is located distally from the arm plate, wherein the device further comprises an electric motor coupled with the lever and the arm, the electric motor configured to drive the arm and the plate into a closed position, wherein the opening of the bag is closed.

2. The device of claim 1, wherein the bag includes material selected from the group of materials consisting of paper, plastic, recycled plastic, and cellulose.

3. The device of claim 1, wherein the bag includes material selected from the group of material consisting of paper, plastic, recycled plastic, and cellulose.

4. The device of claim 1, wherein the arm is rotatably coupled with the lever.

5. The device of claim 1, wherein the plate is rotatably coupled with the lever.

6. The device of claim 5, wherein the arm is rotatably coupled with the lever.

7. The device of claim 1, wherein the bag further comprises an internal adhesive proximate to the opening, wherein the adhesive forms a bond to maintain the bag in a closed position.

8. The device of claim 1, wherein the bag further comprises an external adhesive, wherein the external adhesive forms a bond to maintain the bag in contact with the arm.

9. The device of claim 1, wherein the bag further comprises an external adhesive, wherein the external adhesive forms a bond to maintain the bag in contact with the plate.

10. The device of claim 1, further comprising a handle, the handle configured for manual positioning of the arm and the plate.

11. The device of claim 1, further comprising a pole coupled with the plate.

12. The device of claim 11, wherein the pole comprises a handle shaped for gripping by a human hand.

* * * * *